US006059098A

United States Patent [19]

Ovadia et al.

[11] Patent Number: 6,059,098

[45] Date of Patent: May 9, 2000

[54] JEWELRY CASE WITH PARALLEL, SPACED APART LAYERS OF RING FINGERS THAT ARE OFFSET FROM AND INTERLEAVED WITH EACH OTHER WHEN THE JEWELRY CASE IS CLOSED

[75] Inventors: Joseph Ovadia, Little Falls; Tomasz Zawadzki, Clifton, both of N.J.

[73] Assignee: Ovadia Corp., Little Falls, N.J.

[21] Appl. No.: 09/197,189

[22] Filed: Nov. 20, 1998

[51] Int. Cl.[7] ..... A45C 11/04

[52] U.S. Cl. ..... 206/6.1; 206/566; 206/493; 206/480

[58] Field of Search ..... 206/6.1, 566, 478, 206/480, 482, 493, 483

[56] References Cited

U.S. PATENT DOCUMENTS

| | | | |
|---|---|---|---|
| 1,183,252 | 5/1916 | Sterne | 206/1.6 |
| 1,215,054 | 2/1917 | Olney | 206/1.6 |
| 1,486,629 | 3/1924 | Buchsbaum | 206/1.6 |
| 1,492,113 | 4/1924 | Welsh | 206/566 |
| 2,963,149 | 12/1960 | Bergh et al. | 206/1.6 |
| 3,197,166 | 7/1965 | Sandler | 206/1.6 |
| 3,525,376 | 8/1970 | Muhlhauser | 206/1.6 |
| 4,058,356 | 11/1977 | Michal | 312/305 |
| 4,287,986 | 9/1981 | Beck | 206/1.6 |

*Primary Examiner*—Paul T. Sewell
*Assistant Examiner*—Nhan T. Lam
*Attorney, Agent, or Firm*—Richard M. Goldberg

[57] ABSTRACT

A jewelry case includes a case including a bottom wall, a top wall, and a peripheral structure connected between the bottom and top walls to define at least one compartment therebetween, the peripheral structure including opposite side walls hinged to opposite edges of the bottom wall, and opposite end walls hinged to remaining opposite edges of the bottom wall, with the top wall hinged to an upper edge of one side wall; first ring posts arranged in a plurality of rows mounted to an underside of the top wall and extending toward the bottom wall, with a spacing between first ring posts in each row being at least equal to a width of one first ring post, and first ring posts of each row being offset from first ring posts of adjacent rows; second ring posts arranged in a plurality of rows mounted to an upper surface of the bottom wall and extending toward the top wall, with a spacing between second ring posts in each row being at least equal to a width of one second ring post, second ring posts of each row being offset from second ring posts of adjacent rows, and second ring posts fitting between and interleaved with first ring posts in two orthogonal directions, and each ring post is formed as a thin walled, resilient structure in a part cylindrical configuration that extends at an acute angle, and has opposite free edges and an open, upper end.

20 Claims, 6 Drawing Sheets

JEWELRY CASE WITH PARALLEL, SPACED APART LAYERS OF RING FINGERS THAT ARE OFFSET FROM AND INTERLEAVED WITH EACH OTHER WHEN THE JEWELRY CASE IS CLOSED

BACKGROUND OF THE INVENTION

The present invention relates generally to display and storage devices, and more particularly, is directed to a jewelry case for storing and displaying rings.

One known type of ring tray includes a plurality of projections or fingers extending from a board and on which the rings are situated. With such an arrangement, the trays cannot be stacked upon each other since the projections or fingers would hit the underside of a ring tray stacked thereon.

Accordingly, ring trays have been proposed in which the underside of each ring tray is formed with recesses between the fingers or within the fingers, as disclosed in U.S. Pat. No. 5,649,625. Thus, when a plurality of such trays are stacked upon each other, the rings seated in a lower tray extend into the bottom recesses of the next upper tray. However, the rings in the upper tray are exposed at all times, and it is possible for rings to dislodge from the fingers.

As an alternative to the above, other ring trays are known in which a thin fabric sheet is provided in a rigid plastic ring tray, and a foam pad is positioned beneath the thin fabric sheet for holding the rings. The thin fabric sheet is adhered to the peripheral ledge of the jewelry tray, and to the upper surface of the foam pad. After the thin fabric sheet is adhered to the foam pad, a plurality of slits are die cut therein. This results in the foam pad being likewise die cut and thereby aligned with the slits in the thin fabric sheet. In this manner, a ring can be pushed through a slit in the thin fabric sheet and held by the foam pad. An upper fabric pad having a plurality of openings is adhered to the upper surface of the thin fabric sheet, with the openings in alignment with the slits. However, there are no upstanding projections or fingers for holding the ring, so that much of the ring is hidden during display. Further, since the above ring trays are made from a plurality of different elements and layers, the cost and complexity of manufacturing the same is great.

OBJECTS AND SUMMARY OF THE INVENTION

Accordingly, it is an object of the present invention to provide a jewelry case that overcomes the problems with the aforementioned prior art.

It is another object of the present invention to provide a jewelry case having at least two parallel, spaced apart layers of ring posts, with one layer being inverted over the other in a storage position.

It is still another object of the present invention to provide such a jewelry case in which the ring posts of the two layers are offset from and interleaved with each other in the storage position.

It is another object of the present invention to provide a jewelry case in which the offset and interleaved ring posts face each other and are all at the same inclination to provide an optimum utilization of space.

It is yet another object of the present invention to provide a jewelry case in which the rings cannot inadvertently escape therefrom.

It is a further object of the present invention to provide a jewelry case having an opening through which two parallel, spaced apart layers of ring posts can be inserted, with the ring posts of each layer facing the other layer and being offset and interleaved with the ring posts of the other layer.

It is a still further object of the present invention to provide a jewelry case that is lightweight and durable, and easy and economical to manufacture and use.

In accordance with an aspect of the present invention, a jewelry case includes a case having a bottom wall, a top wall, and a peripheral side wall structure connected to the bottom wall so as to define at least one compartment between the bottom wall and the top wall; a first arrangement of first ring posts extending downwardly from a position adjacent to or connected with the top wall toward the bottom wall, the first ring posts being arranged in a plurality of rows, with a spacing between the first ring posts in each row being at least equal to a width of one first ring post; and a second arrangement of second ring posts extending upwardly from a position adjacent to or connected with the bottom wall toward the top wall, the second ring posts being arranged in a plurality of rows, with a spacing between the second ring posts in each row being at least equal to a width of one second ring post, and with the second ring posts fitting between and interleaved with the first ring posts.

The first ring posts of each row are offset from the first ring posts of adjacent rows, and the second ring posts of each row are offset from the second ring posts of adjacent rows. The second ring posts fit between and interleave with the first ring posts in first and second orthogonal directions.

Preferably, each first and second ring post is formed as a thin walled, resilient structure in a part cylindrical configuration that extends at an acute angle, and has opposite free edges. Also, each ring post has an open, upper end.

The first ring posts are mounted to a first planar panel and the second ring posts are mounted to a second planar panel and a lower edge of each ring post is detached from the respective planar panel for a small arcuate amount, starting from the opposite free edges of each ring post toward a rear of the respective ring post.

In one embodiment, the first ring posts are mounted to an underside of the top wall, and the second ring posts are mounted to an upper surface of the bottom wall. Specifically, the bottom wall has a rectangular shape with four side edges; the peripheral wall structure includes opposite side walls hinged to opposite edges of the bottom wall, and opposite end walls hinged to remaining opposite edges of the bottom wall; and the top wall is hinged to an upper edge of one of the side walls. The jewelry case further includes a first end flap hinged to an upper edge of one of the end walls and a second end flap hinged to an upper edge of the other of the end walls for overlapping the first end flap in a closed condition of the jewelry case, with at least one of the first and second end flaps having a securing device to releasably close the jewelry case. The securing device includes a layer of loops secured to the first end flap and a layer of hooks secured to the second end flap. Alternatively, the securing device includes a snap arrangement.

In another embodiment, the first ring posts are mounted to a first planar panel, and the second ring posts are mounted to a second planar panel, and the first planar panel can be inverted and positioned on the second planar panel to form a combined structure that is positioned in the compartment. In such case, the bottom wall has a rectangular shape with four side edges; the peripheral wall structure includes: opposite side walls connected to opposite edges of the bottom wall, and opposite end walls connected to remaining opposite edges of the bottom wall; and the top wall is hinged to an upper edge of one of the side walls.

In one case, the jewelry case includes a plurality of the compartments.

In accordance with another aspect of the present invention, a jewelry case includes a case including a bottom wall, a top wall, and a peripheral side wall structure connected to the bottom wall so as to define at least one compartment between the bottom wall and the top wall; a first arrangement of first ring posts extending downwardly from a position adjacent to or connected with the top wall toward the bottom wall, the first ring posts being arranged in a plurality of rows, with a spacing between the first ring posts in each row being at least equal to a width of one first ring post, and the first ring posts of each row being offset from the first ring posts of adjacent rows; a second arrangement of second ring posts extending upwardly from a position adjacent to or connected with the bottom wall toward the top wall, the second ring posts being arranged in a plurality of rows, with a spacing between the second ring posts in each row being at least equal to a width of one second ring post, the second ring posts of each row are offset from the second ring posts of adjacent rows, and with the second ring posts fitting between and interleaved with the first ring posts in first and second orthogonal directions.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 3A:
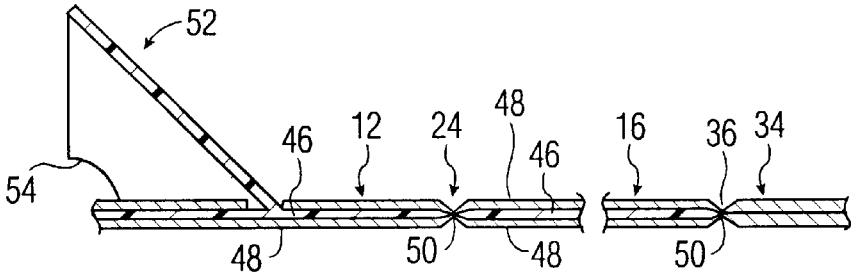
FIG. 3A is an end elevational view of the jewelry case of FIG. 1, with one end flap open.
Figure 3:
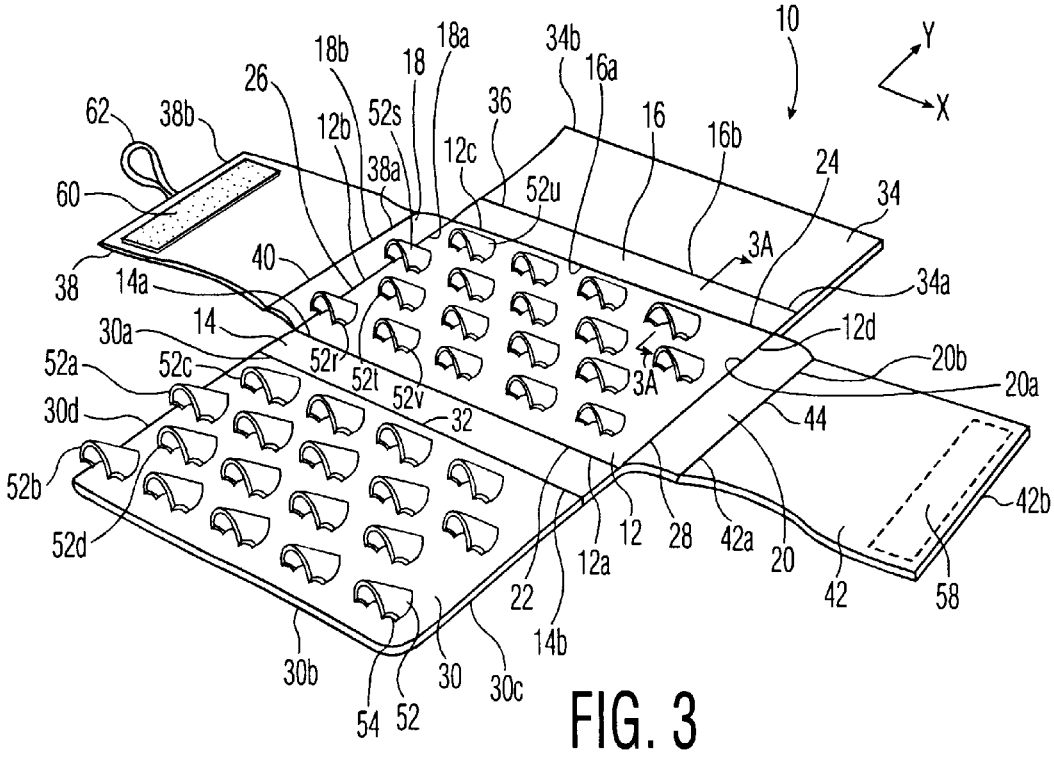
FIG. 3 is a perspective view of the jewelry case of FIG. 1 in a fully opened condition.

Referring to the drawings in detail, and initially to FIG. 3 thereof, a jewelry case 10 according to a first embodiment of the present invention includes a rectangular bottom wall 12 having outer edges 12*a*–12*d*. Two narrow rectangular side walls 14 and 16 have opposite longer edges 14*a* and 14*b*, and 16*a* and 16*b*, respectively, with edges 14*a* and 16*a* being connected to edges 12*a* and 12*c* of bottom wall 12 along respective fold or hinge lines 22 and 24. In like manner, two narrow rectangular end walls 18 and 20 have opposite longer edges 18*a* and 18*b*, and 20*a* and 20*b*, respectively, with edges 18*a* and 20*a* being connected to edges 12*b* and 12*d* of bottom wall 12 along respective fold or hinge lines 26 and 28.

A rectangular top wall 30 has opposite longer edges 30*a* and 30*b*, with edge 30*a* being connected to edge 14*b* of side wall 14 along a fold or hinge line 32. An opposite rectangular top flap 34 has opposite longer edges 34*a* and 34*b*, with edge 34*a* being connected to edge 16*b* of side wall 16 along a fold or hinge line 36.

A rectangular end flap 38 has opposite shorter edges 38*a* and 38*b*, with edge 38*a* being connected to edge 18*b* of end wall 18 along a fold or hinge line 40. An opposite rectangular end flap 42 has opposite shorter edges 42*a* and 42*b*, with edge 42*a* being connected to edge 20*b* of end wall 20 along a fold or hinge line 44.

The different walls and flaps can be made of any suitable material and have any suitable rigidity. Preferably, bottom wall 12, side walls 14 and 16, and top wall 30 are made of a molded, flexible, tough and lightweight plastic or rubber planar panel 46, covered by a fabric or cloth material 48. As a result, bottom wall 12, side walls 14 and 16, and top wall 30 have some rigidity, but can also be flexed. The remaining end walls 18 and 20, top flap 34 and end flaps 38 and 40 do not have any plastic panel, but are merely a continuation of the fabric material 48. The fold or hinge lines 22, 24, 26, 28, 32, 36, 40 and 44 are formed by stitching of fabric material 48 thereat by thread stitches or weld lines 50.

Figure 4:
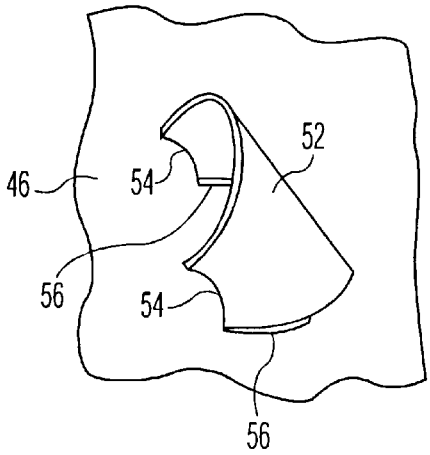
FIG. 4 is a perspective view of one ring post of the jewelry case of FIG. 1.

Bottom wall 12 and top wall 30 are each formed with a plurality of ring posts 52, which are formed in a mold with the plastic panels 46 thereof. As shown best in FIGS. 2–4, each ring post 52 is formed as a thin walled structure in a part cylindrical configuration that extends upwardly at an acute angle of, for example, 45°, from plastic planar panel 46. This configuration permits a ring to be placed on each ring post 52. In such case, the wall of ring post 52 can be compressed, and when a ring is positioned thereon, the wall of the ring post 52, which is resilient, will expand back outwardly so that the ring is securely held thereon.

Each ring post 52 is preferably integrally molded with plastic planar panel 46. The upper end of each ring post 52 is open. Preferably, although not essential, the side edges of each ring post 52 are cut-away to provide an arcuate edge 54, the lower edge of which is coincident with the lower edge of ring post 52. It will be appreciated that the ring tags are positioned behind the ring posts 52 and are therefore hidden for a clearer presentation.

The lower edge of each ring post 52 is preferably detached from planar plastic panel 46 at detached portions 56 for a small arcuate amount, for example, 15°–20°, starting from the opposite free edges thereof toward the rear thereof. This provides flexibility to permit the ring post 52 to be bent rearwardly in order to better position a ring thereon and to remove a ring therefrom. This also provides that different size rings fit on ring post 52 will force ring post 52 into the appropriate angular position, that is, with the ring band abutting against planar panel 46 to move ring post 52 to the appropriate angle. By providing detached lower portions 56 of ring post 52, such angular adjustment can be provided.

Ring posts 52 of bottom wall 12 are provided in a plurality of rows, with a spacing between ring posts 52 in each row being equal to a width of a ring post 52. As shown, there are four rows, with two alternate rows having four spaced ring posts 52, and the other two alternate rows having five spaced ring posts 52. Further, in accordance with an important aspect of the present invention, the ring posts 52 of the different rows are offset from each other.

Ring posts 52 of top wall 30 are also provided in a plurality of rows on the underside thereof, with a spacing between ring posts 52 in each row being equal to a width of a ring post 52. As shown, there are four rows, with two alternate rows having four spaced ring posts 52, and the other two alternate rows having five spaced ring posts 52. In accordance with an important aspect of the present invention, the ring posts 52 of the different rows are offset from each other. In this manner, when jewelry case 10 is closed, top wall 30 is inverted in parallel, spaced apart relation over bottom wall 12, such that the ring posts 52 of top wall 30 fit between and are interleaved with the ring posts 52 of bottom wall 12. For example, ring posts 52*a* and 52*b* of top wall 30 interleave with ring posts 52*r* and 52*s* of bottom wall 12 in the Y-direction of FIG. 3. In like manner, ring posts 52*c* and 52*d* of top wall 30 interleave with ring posts 52*t* and 52*u* of bottom wall 12 in the Y-direction of FIG. 3. In like manner, there is an interleaving in the X-direction of FIG. 3. For example, ring post 52*c* of top wall 30 is interleaved between ring posts 52*r* and 52*v* of bottom wall 12 in the X-direction of FIG. 3.

Figure 2:
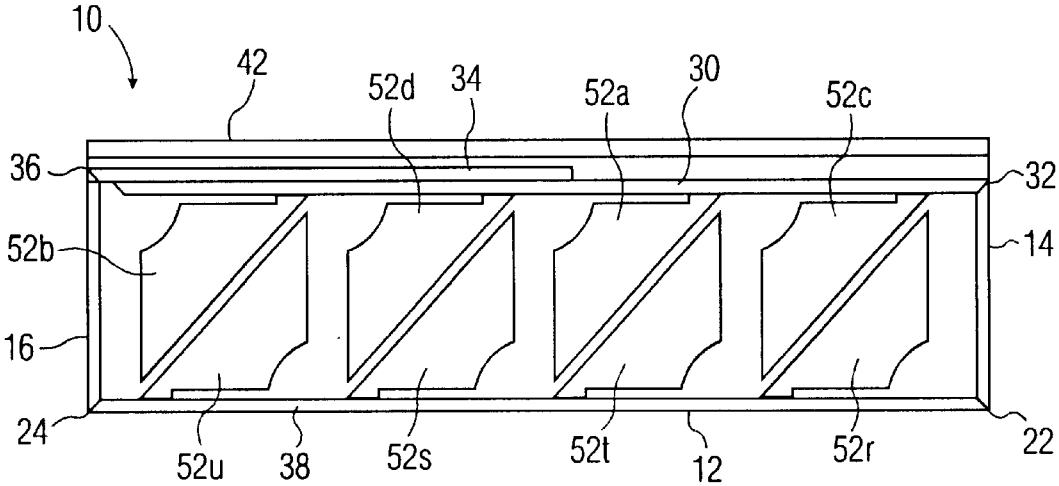
FIG. 2 is a cross-sectional view of the jewelry case of FIG. 1, taken along line 2—2 thereof.

In addition, the offset and interleaved ring posts 52 of bottom wall 12 and top wall 30 face each other, as shown best in FIG. 2, and are all at the same inclination to provide an optimum utilization of space. With this arrangement, rings mounted on ring posts 52 cannot inadvertently escape therefrom.

Figure 1:
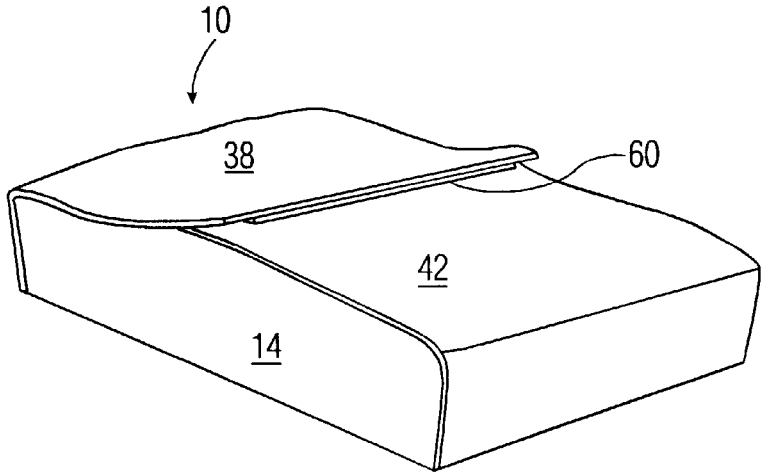
FIG. 1 is a perspective view of a jewelry case in a closed condition, according to a first embodiment of the present invention.

In order to close jewelry case 10 from the position shown in FIG. 3 to the position shown in FIG. 1, side wall 14 is folded to an upright position about fold line 22, and then top wall 30 is folded about fold line 32 so that top wall 30 is positioned in parallel, spaced apart relation over bottom wall 12, with ring posts 52 thereof offset and interleaved with ring posts 52 of bottom wall 12. Then, side wall 16 is folded to an upright position about fold line 24, followed by top flap 34 being folded about fold line 36 so as to lay on top of top wall 30. Thereafter, end wall 20 is folded to an upright position about fold line 28, and then end flap 42 is folded about fold line 44 so as to lay on top of top wall 30 and top flap 34. Finally, end all 18 is folded to an upright position about fold line 26, and then end flap 38 is folded about fold line 40 so as to lay on top of top wall 30 and top flap 34, and to partially overlap end flap 42.

In order to releasably retain jewelry case 10 in this closed condition, a layer of hooks 58 is secured to the upper surface of end flap 42, and a layer of loops 60 is secured to the lower surface of end flap 38. When end flap 38 partially overlaps end flap 42, the layer of loops 60 overlaps the layer of hooks 58 to provide such releasable securement. This arrangement is commonly sold under the trademark "VELCRO."

Figure 3B:
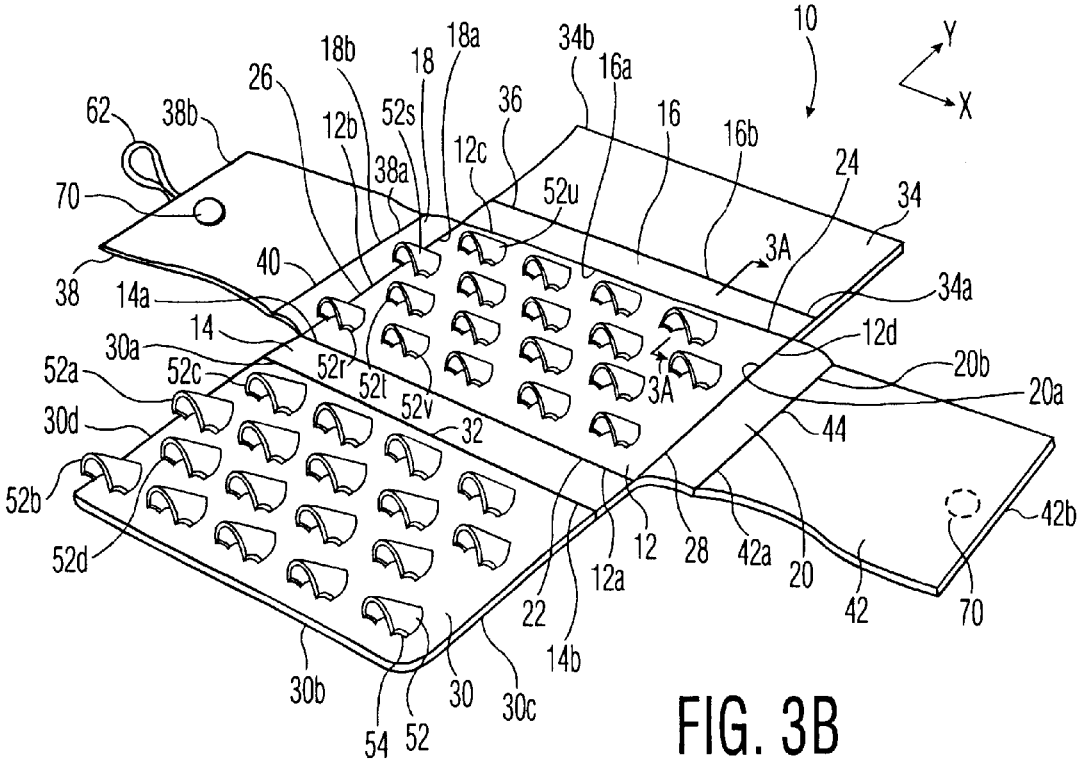
FIG. 3B is a perspective view of an alternative jewelry case similar to FIG. 3 in a fully opened condition, with a snap securement.

However, other suitable alternative arrangements can be provided for such releasable securement. For example, an elastic strap 62 can be secured to edge 38*b* of end flap 38 and be stretched about jewelry case 10 in the closed condition. Alternatively, a zipper or snap arrangement 70 (FIG. 3B) could be provided. For example, top flap 34 and end flaps 38 and 42 could be eliminated, and a zipper provided to secure end edge 30*c* of top wall 30 to top edge 20*b*, outer edge 30*b* to top edge 34*a* and end edge 30*d* of top wall 30 to top edge 18*b*.

Figure 5:
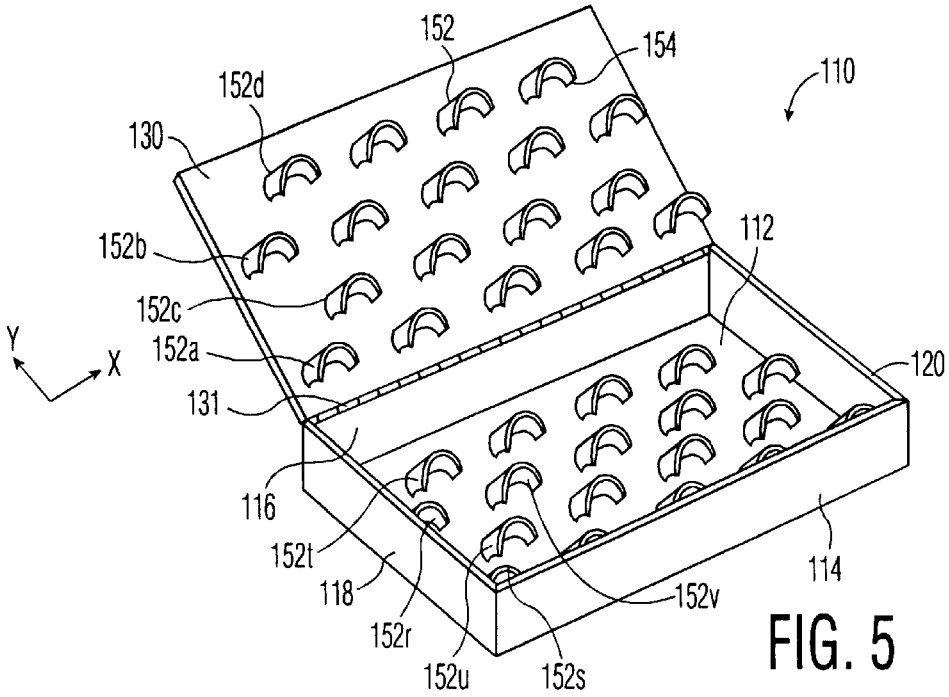
FIG. 5 is a perspective view of a jewelry case in an open condition, according to a second embodiment of the present invention.

Referring now to FIG. 5, there is shown a jewelry case 110 according to a second embodiment of the present invention, in an open condition. Jewelry case 110 includes a relatively rigid, plastic bottom wall 112, side walls 114 and 116 and end walls 118 and 120, along with a top cover 130 hinged to the upper edge of side wall 116 by a hinge 131. Alternatively, top wall 130 can be provided in detached form and merely seat on the upper edges of the side walls with a friction fit. Although jewelry case 110 is shown as being made out of a molded plastic material, jewelry case 110 can be made out of any suitable material.

Bottom wall 112 and top wall 130 are each formed with a plurality of ring posts 152, which are formed in a mold with the plastic panels thereof. Each ring post 152 is formed as a thin walled structure in a part cylindrical configuration that extends upwardly at an acute angle of, for example, 45°, from the plastic planar panel of bottom wall 112 or top wall 130. This configuration permits a ring to be placed on each ring post 152. In such case, the wall of ring post 152 can be compressed, and when a ring is positioned thereon, the wall of the ring post 152, which is resilient, will expand back outwardly so that the ring is securely held thereon.

Each ring post 152 is preferably integrally molded with bottom wall 112 or top wall 130. The upper end of each ring post 152 is open. Preferably, although not essential, the side edges of each ring post 152 are cut-away to provide an arcuate edge 154, the lower edge of which is coincident with the lower edge of ring post 152.

The lower edge of each ring post 152 is preferably detached from planar plastic panel 46 at detached portions the same as those of ring posts 52 of FIGS. 1–4, for a small arcuate amount, for example, 15°–20°, starting from the opposite free edges thereof toward the rear thereof. This provides flexibility to permit the ring post 152 to be bent rearwardly in order to better position a ring thereon and to remove a ring therefrom. This also provides that different size rings fit on ring post 152 will force ring post 152 into the appropriate angular position, that is, with the ring band abutting against the planar panel of bottom wall 112 or top wall 130 to move ring post 152 to the appropriate angle. By providing detached lower portions of ring post 152, such angular adjustment can be provided.

Ring posts 152 of bottom wall 112 are provided in a plurality of rows, with a spacing between ring posts 152 in each row being equal to a width of a ring post 152. As shown, there are four rows, with two alternate rows having four spaced ring posts 152, and the other two alternate rows having five spaced ring posts 152. Further, in accordance with an important aspect of the present invention, the ring posts 152 of the different rows are offset from each other.

Ring posts 152 of top wall 130 are also provided in a plurality of rows on the underside thereof, with a spacing between ring posts 152 in each row being equal to a width of a ring post 152. As shown, there are four rows, with two alternate rows having four spaced ring posts 152, and the other two alternate rows having five spaced ring posts 152. In accordance with an important aspect of the present invention, the ring posts 152 of the different rows are offset from each other. In this manner, when jewelry case 110 is closed, top wall 130 is inverted in parallel, spaced apart relation over bottom wall 112, such that the ring posts 152 of top wall 130 fit between and are interleaved with the ring posts 152 of bottom wall 112. For example, ring posts 152*a* and 152*b* of top wall 130 interleave with ring posts 152*r* and 152*s* of bottom wall 112 in the Y-direction of FIG. 5. In like manner, ring posts 152*c* and 152*d* of top wall 130 interleave with ring posts 152*t* and 152*u* of bottom wall 112 in the Y-direction of FIG. 5. In like manner, there is an interleaving in the X-direction of FIG. 5. For example, ring post 152*c* of top wall 130 is interleaved between ring posts 152*r* and 152*v* of bottom wall 112 in the X-direction of FIG. 5.

In addition, the offset and interleaved ring posts 152 of bottom wall 112 and top wall 130 face each other, in the same manner as shown in FIG. 2, and are all at the same inclination to provide an optimum utilization of space. With this arrangement, rings mounted on ring posts 152 cannot inadvertently escape therefrom.

Figure 6:
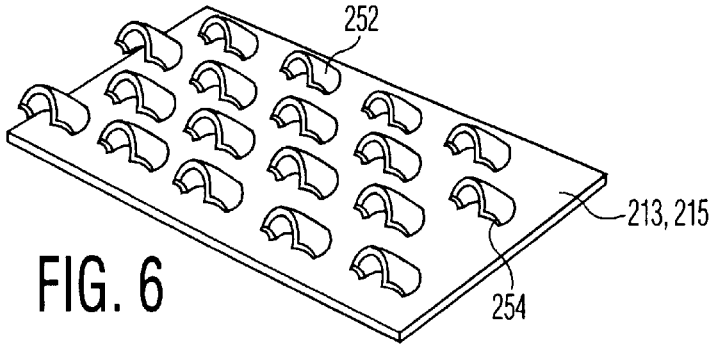
FIG. 6 is a perspective view of one layer of ring posts according to a third embodiment of the present invention.
Figure 8:
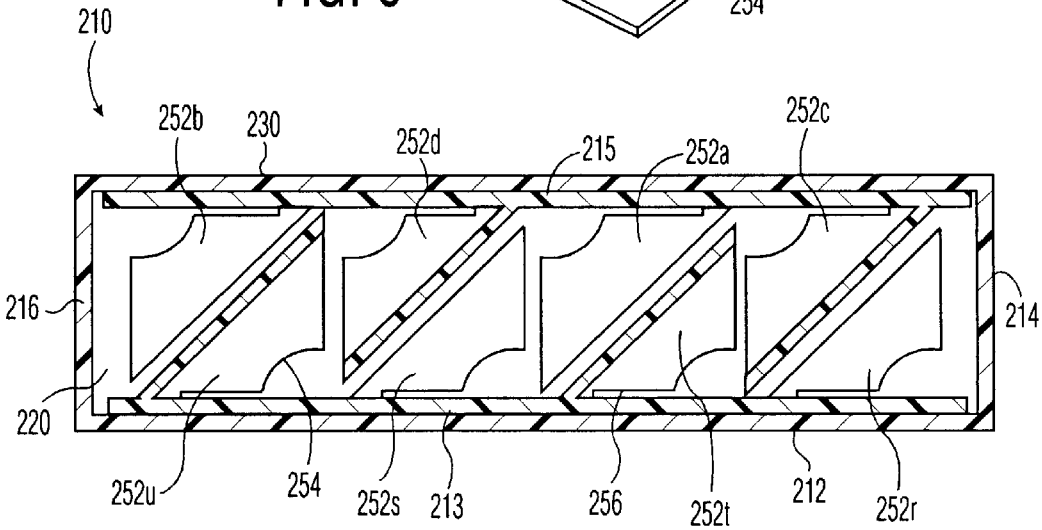
FIG. 8 is a cross-sectional view of the jewelry case of FIG. 7, taken along line 8—8 thereof, with two layers of rings posts positioned therein.
Figure 7:
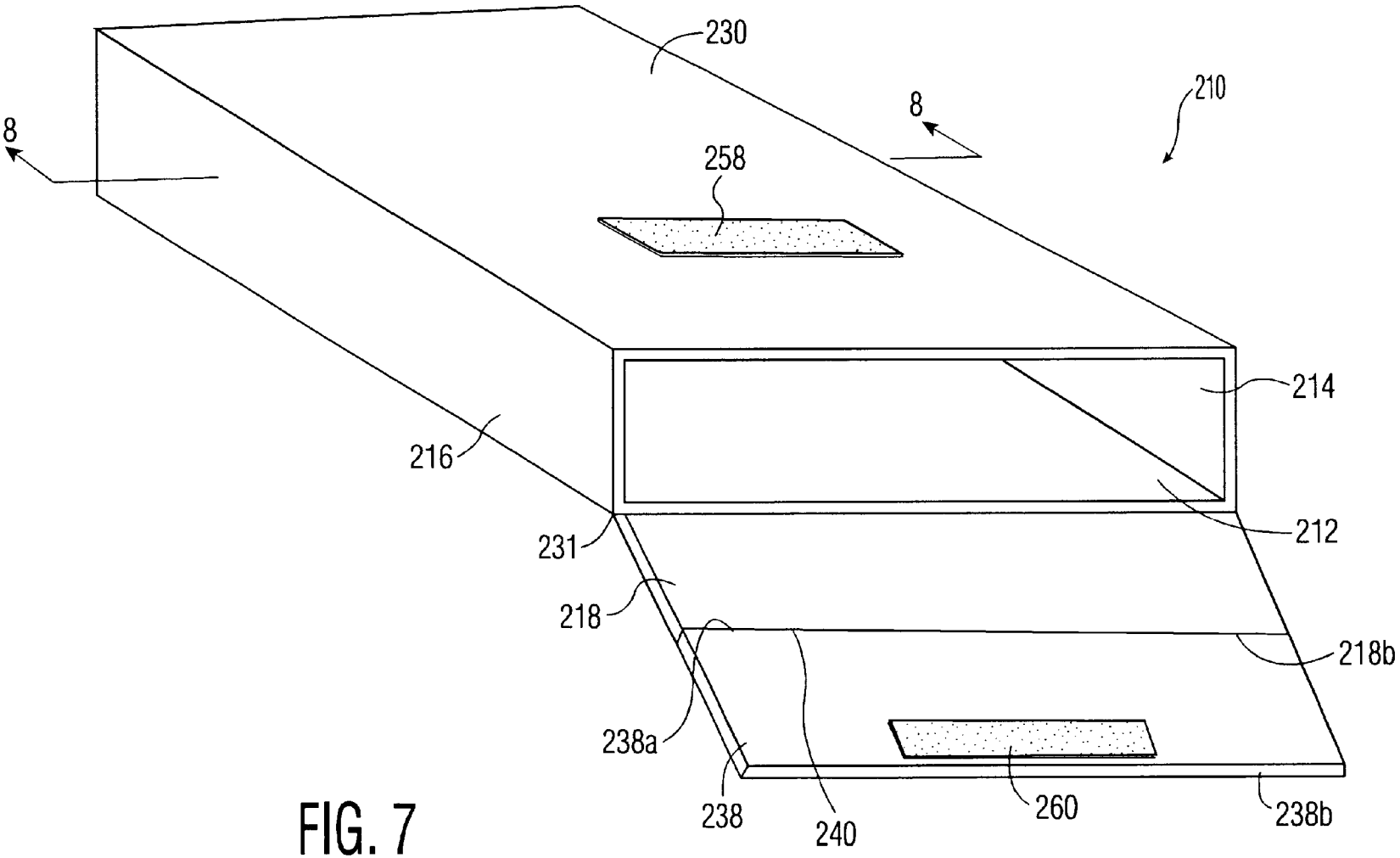
FIG. 7 is a perspective view of a jewelry case according to the third embodiment of the present invention, without the layers of ring posts positioned therein.

Referring now to FIGS. 6–8, there is shown a jewelry case 210 according to a second embodiment of the present invention, in an open condition. Jewelry case 210 includes a relatively rigid, plastic bottom wall 212, side walls 214 and 216 and end walls 218 and 220, along with a top wall 230. End wall 218 is hinged to a lower edge of bottom wall 212 by a living hinge 231. Although jewelry case 210 is shown as being made out of a molded plastic material, jewelry case 210 can be made out of any suitable material.

In addition, a rectangular top flap 238 has opposite longer edges 238*a* and 238*b*, with edge 238*a* being connected to longer edge 218*b* of end wall 218 along a living hinge 240. When end wall 218 is in the raised condition, top flap 238 can be folded over top wall 230. In such case, a layer of hooks 258 is secured to the upper surface of top wall 230, and a layer of loops 260 is secured to the lower or inner surface of end flap 238. When end flap 238 partially overlaps top wall 230, the layer of loops 260 overlaps the layer of hooks 258 to provide releasable securement. This arrangement is commonly sold under the trademark "VELCRO."

Unlike the aforementioned embodiments, in this embodiment, two planar plastic panels 213 and 215 are provided, each formed with a plurality of ring posts 252, which are formed in a mold with plastic panels 213 and 215. Each ring post 252 is formed as a thin walled structure in a part cylindrical configuration that extends upwardly at an acute angle of, for example, 45°, from the plastic planar panel 213 or 215. This configuration permits a ring to be placed on each ring post 252. In such case, the wall of ring post 252 can be compressed, and when a ring is positioned thereon, the wall of the ring post 252, which is resilient, will expand back outwardly so that the ring is securely held thereon.

Each ring post 252 is preferably integrally molded with plastic panel 213 or 215. The upper end of each ring post 252 is open. Preferably, although not essential, the side edges of each ring post 252 are cut-away to provide an arcuate edge 254, the lower edge of which is coincident with the lower edge of ring post 252.

The lower edge of each ring post 252 is preferably detached from planar plastic panel 46 at detached portions 256 for a small arcuate amount, for example, 15°–20°, starting from the opposite free edges thereof toward the rear thereof. This provides flexibility to permit the ring post 252 to be bent rearwardly in order to better position a ring thereon and to remove a ring therefrom. This also provides that different size rings fit on ring post 252 will force ring post 252 into the appropriate angular position, that is, with the ring band abutting against the planar panel 213 or 215 to move ring post 252 to the appropriate angle. By providing detached lower portions 256 of ring post 252, such angular adjustment can be provided.

Ring posts 252 of each panel 213 or 215 are provided in a plurality of rows, with a spacing between ring posts 252 in each row being equal to a width of a ring post 252. As shown, there are four rows, with two alternate rows having four spaced ring posts 252, and the other two alternate rows having five spaced ring posts 252. Further, in accordance with an important aspect of the present invention, the ring posts 252 of the different rows are offset from each other.

In this manner, panel 215 is inverted and placed on top of panel 213 so that panels 213 and 215 are in parallel, spaced apart relation, such that the ring posts 252 of top panel 215 fit between and are interleaved with the ring posts 252 of bottom panel 213. For example, ring posts 252*a* and 252*b* of top panel 215 interleave with ring posts 252*r* and 252*s* of bottom panel 213 in the Y-direction of FIG. 8. In like manner, ring posts 252*c* and 252*d* of top panel 215 interleave with ring posts 252*t* and 252*u* of bottom panel 213 in the Y-direction of FIG. 8. In like manner, there is an interleaving in the X-direction of FIG. 8, in the same manner as described in the aforementioned embodiments.

In addition, the offset and interleaved ring posts 252 of bottom panel 213 and top panel 215 face each other, in the same manner as shown in FIG. 8, and are all at the same inclination to provide an optimum utilization of space. With this arrangement, rings mounted on ring posts 252 cannot inadvertently escape therefrom.

In use, panel 215 is inverted and placed on top of panel 213, so that ring posts 252 are interleaved with each other. Then, panels 213 and 215 are slid into jewelry case 210, as shown in FIG. 8, whereupon end wall 218 is raised and end flap 238 is positioned on top wall 230 to releasably secure the same thereon by the aforementioned "VELCRO" arrangement.

Figure 9:
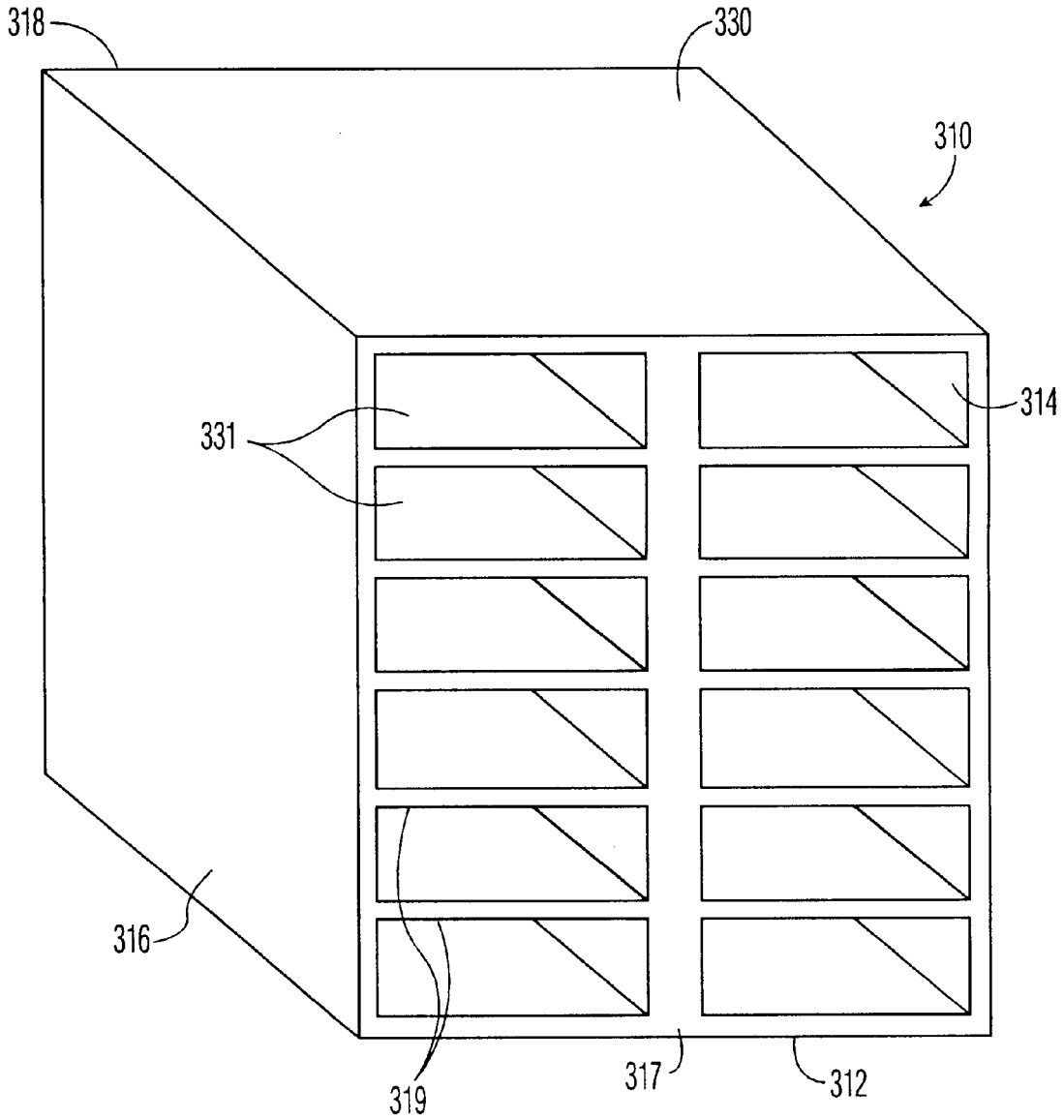
FIG. 9 is a perspective view of a jewelry case according to a fourth embodiment of the present invention for use holding multiple layers of ring posts.

FIG. 9 is a perspective view of a jewelry case 310 according to a fourth embodiment of the present invention. Specifically, jewelry case 310 includes a relatively rigid, plastic bottom wall 312, side walls 314 and 316, rear wall 320 and top wall 330, thereby leaving a front open end. Although jewelry case 310 is preferably made out of a molded plastic material, jewelry case 310 can be made out of any suitable material.

A central, vertical wall 317 extending between bottom wall 312 and top wall 330 bisects jewelry case 310 into a left side and a right side. Further, each side is divided into a plurality of compartments 331 in a row on each side by horizontal dividing walls 319.

In use, a panel 215 is inverted and placed on top of a panel 213, so that ring posts 252 are interleaved with each other. Then, panels 213 and 215 are slid into one compartment 331 of jewelry case 310. The procedure is repeated for different pairs of panels 213 and 215 and different compartments 331. Of course, a suitable closure can be provided, such as that shown in FIG. 8, a zipper closure or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry case comprising:

a case including:

a bottom wall, a top wall, and a side wall structure connected to the bottom wall so as to define at least one compartment between the bottom wall and the top wall;

a first arrangement of first ring posts extending downwardly from a surface in a direction facing toward said bottom wall in a closed configuration of the jewelry case, said first ring posts being arranged in a plurality of rows, with a spacing between said first ring posts in each row being at least equal to a width of one said first ring post; and a second arrangement of second ring posts extending upwardly from a surface in a direction facing toward said top wall in said closed configuration of the jewelry case, maid second ring posts being arranged in a plurality of rows, with a spacing between said second ring posts in each row being at least equal to a width of one said second ring post, and with said second ring posts fitting between and interleaved with said first ring posts in one said compartment in said closed configuration of said jewelry case.

2. A jewelry case according to claim 1, wherein said first ring posts of each row are offset from said first ring posts of adjacent rows, and said second ring posts of each row are offset from said second ring posts of adjacent rows.

3. A jewelry case according to claim 1, wherein said second ring posts fit between and interleave with said first ring posts in first and second orthogonal directions.

4. A jewelry case according to claim 1, wherein each said first and second ring post is formed as a thin walled, resilient structure in an arcuate configuration that extends at an acute angle relative to said top wall and bottom wall in said closed configuration of the jewelry case, and has opposite free edges.

5. A jewelry case according to claim 4, wherein each said ring post has an open, upper end.

6. A jewelry case according to claim 4, wherein said first ring posts are mounted to a first planar panel and said second ring posts are mounted to a second planar panel and a lower edge of each said ring post is detached from the respective planar panel for a small arcuate amount, starting from said opposite free edges of each ring post toward a rear of the respective ring post.

7. A jewelry case according to claim 1, wherein there is one said compartment, and said first ring posts are mounted to an underside of said top wall, and said second ring posts are mounted to an upper surface of said bottom wall.

8. A jewelry case according to claim 1, wherein said first ring posts are mounted to a first planar panel, and said second ring posts are mounted to a second planar panel, and said first planar panel can be inverted and positioned on said second planar panel to form a combined structure that is positioned in one said compartment.

9. A jewelry case according to claim 1, wherein:

said bottom wall has a rectangular shape with four side edges;

said wall structure includes:

opposite side walls hinged to opposite edges of said bottom wall, and opposite end walls hinged to remaining opposite edges of said bottom wall; and said top wall is hinged to an upper edge of one of said side walls.

10. A jewelry case according to claim 9, wherein said jewelry case further includes a first end flap hinged to an upper edge of one of said end walls and a second end flap hinged to an upper edge of the other of said end walls for overlapping said first end flap in a closed condition of said jewelry case, with at least one of said first and second end flaps having a securing device to releasably close said jewelry case.

11. A jewelry case according to claim 10, wherein said securing device includes a layer of loops secured to said first end flap and a layer of hooks secured to said second end flap.

12. A jewelry case according to claim 10, wherein said securing device includes a snap arrangement.

13. A jewelry case according to claim 1, wherein:

said bottom wall has a rectangular shape with four side edges;

said wall structure includes:

opposite side walls connected to opposite edges of said bottom wall, and opposite end walls connected to remaining opposite edges of said bottom wall; and said top wall is hinged to an upper edge of one of said side walls.

14. A jewelry case according to claim 1, wherein said jewelry case includes a plurality of said compartments.

15. A jewelry case comprising:

a case including:

a bottom wall, a top wall, and a side wall structure connected to the bottom wall so as to define at least one compartment between the bottom wall and the top wall;

a first arrangement of first ring posts extending downwardly from a surface in a direction facing toward said bottom wall in a closed configuration of the jewelry case, said first ring posts being arranged in a plurality of rows, with a spacing between said first ring posts in each row being at least equal to a width of one said first ring post, and said first ring posts of each row being offset from said first ring posts of adjacent rows;

a second arrangement of second ring posts extending upwardly from a surface in a direction facing toward said top wall in said closed configuration of the jewelry case, said second ring posts being arranged in a plurality of rows, with a spacing between said second ring posts in each row being at least equal to a width of one said second ring post, said second ring posts of each row are offset from said second ring posts of adjacent rows, and with said second ring posts fitting between and interleaved with said first ring posts in first and second orthogonal directions in one said compartment in said closed configuration of said jewelry case.

16. A jewelry case according to claim 15, wherein each said first and second ring post is formed as a thin walled, resilient structure in a part cylindrical configuration that extends at an acute angle, and has opposite free edges and an open, upper end.

17. A jewelry case according to claim 15, wherein said first ring posts are mounted to a first planar panel and said second ring posts are mounted to a second planar panel and a lower edge of each said ring post is detached from the respective planar panel for a small arcuate amount, starting from said opposite free edges of each ring post toward a rear of the respective ring post.

18. A jewelry case according to claim 15, wherein said first ring posts are mounted to an underside of said top wall, and said second ring posts are mounted to an upper surface of said bottom wall.

19. A jewelry case according to claim 15, wherein said first ring posts are mounted to a first planar panel, and said second ring posts are mounted to a second planar panel, and said first planar panel can be inverted and positioned on said second planar panel to form a combined structure that is positioned in said compartment.

20. A jewelry case according to claim 15, wherein:

said bottom wall has a rectangular shape with four side edges;

said wall structure includes:

opposite side walls hinged to opposite edges of said bottom wall, and opposite end walls hinged to remaining opposite edges of said bottom wall; and said top wall is hinged to an upper edge of one of said side walls.

* * * * *